United States Patent [19]

Goerlich

[11] Patent Number: 4,945,722

[45] Date of Patent: Aug. 7, 1990

[54] SOOT FILTERING UNIT FOR THE EXHAUST OF A DIESEL INTERNAL COMBUSTION ENGINE AND METHOD FOR REGENERATING THE FILTERS THEREOF

[75] Inventor: Dieter Goerlich, Emmering, Fed. Rep. of Germany

[73] Assignee: Webasto AG Fahrzeugtechnik, Fed. Rep. of Germany

[21] Appl. No.: 196,558

[22] Filed: May 20, 1988

[30] Foreign Application Priority Data

May 21, 1987 [DE] Fed. Rep. of Germany ..... 3717140

[51] Int. Cl.[5] ..... F01N 3/02

[52] U.S. Cl. ..... 60/295; 55/312; 55/313; 55/314; 55/466; 55/DIG. 30; 60/303; 60/311

[58] Field of Search ..... 60/274, 286, 303, 311, 60/295; 55/312, 313, 314, 466, DIG. 30

[56] References Cited

U.S. PATENT DOCUMENTS

| | | | |
|---|---|---|---|
| 4,335,574 | 6/1982 | Sato et al. . | |
| 4,345,431 | 8/1982 | Suzuki et al. . | |
| 4,373,330 | 2/1983 | Stark . | |
| 4,381,643 | 5/1983 | Stark . | |
| 4,574,589 | 3/1986 | Hasegawa | 60/311 |
| 4,720,972 | 1/1988 | Rao | 60/295 |
| 4,730,455 | 3/1988 | Pischinger | 60/295 |

FOREIGN PATENT DOCUMENTS

| | | |
|---|---|---|
| 0020766 | 1/1981 | European Pat. Off. . |
| 3204176 | 8/1983 | Fed. Rep. of Germany . |
| 3526135 | 3/1986 | Fed. Rep. of Germany . |
| 57-79209 | 5/1982 | Japan . |
| 60-230507 | 11/1985 | Japan . |
| 2013103 | 8/1979 | United Kingdom . |

*Primary Examiner*—Douglas Hart

*Attorney, Agent, or Firm*—Sixbey, Friedman, Leedom & Ferguson

[57] ABSTRACT

A soot filtering unit in the exhaust gas system of a diesel internal combustion engine that includes at least two parallel soot filters. For regeneration, a regeneration device, having at least one burner and control flap, is provided upstream from the soot filters of the soot filtering unit. The burner(s) provided in the soot filtering unit supplies high temperature gases for the regeneration of the soot filters, and exhaust gas from the exhaust gas pipe is fed thereto as an oxygen carrier for the combustion process. According to a first embodiment, a single burner is provided for all soot filters to be regenerated and the burner does not lie directly in the pipes of the exhaust gas pipe that conveys exhaust gas to the soot filters. Preferably, exhaust gas is supplied to the burner(s) through separate exhaust gas feed pipes but, alternatively, a separate burner can be located directly in each branch of the exhaust pipe upstream of the respective soot filter provided therein. In the latter case, the burner can be supplied directly by a predetermined amount of exhaust gas being permitted to leak past the control flaps when they are closed.

15 Claims, 2 Drawing Sheets

SOOT FILTERING UNIT FOR THE EXHAUST OF A DIESEL INTERNAL COMBUSTION ENGINE AND METHOD FOR REGENERATING THE FILTERS THEREOF

BACKGROUND AND SUMMARY OF THE INVENTION

The invention relates to a soot filtering unit in the exhaust discharge section of a diesel internal combustion engine which comprises at least two parallel soot filters and a regeneration device with at least one burner. In particular, the invention relates to such a unit wherein at least one control flap is used, to control the paths of the engine exhaust gas and the regenerative gas, at a point situated upstream from the soot filters.

Soot filtering units of the type to which the invention relates are known. For example, from U.S. Pat. No. 4,345,431 as well as from German Offenlegungsschrift 32 04 176. In the case of both of these prior art arrangements, for carrying out the combustion process, a supply of external air is delivered to the burner.

If burners are operated with air as an oxidation agent, and if these burners are to work with low air pressure, it is necessary that the control flaps for the control of the regeneration process be reliably tight which, however, with regard to the high temperatures prevailing there and/or because of the tendency toward fouling, causes difficulties in general, at least with long-term operation. Thus an effort is made to make leaky flaps reliable. The result is a higher blower output, which is generally not available in motor vehicles.

On the other hand, it has been shown that, with the use of an exhaust gas afterburner through which all of the exhaust gas of the internal combustion engine flows, for the regeneration process such burners must have a high burner output for the generation of hot combustible gases. At the same time, the output must still be controllable to be able to meet the desired requirements for regeneration in this application. Also, if burners are used to regenerate soot filters, the entire exhaust gas unit should be adapted to the burner features or vice versa to guarantee a reliable operation of the burner for the regeneration process of the soot filters.

Thus, a primary object of the invention is to enable the difficulties, described above, to be overcome while providing a soot filtering unit that makes possible, even with leaky control flaps, a reliable regeneration of the soot filters in a structurally simple way and without the exhaust gas unit and the burner devices having to be provided with complicated and cost-intensive measures. A further important object of the invention is to provide an arrangement wherein one or more low output burners can be used while enabling maximum operating reliability to be attained.

According to preferred embodiments of the invention, those objects are achieved by a soot filtering unit in the exhaust discharge section of a diesel internal combustion engine of the type having at least two parallel soot filters and a regeneration device with at least one burner, and at least one control flap is placed upstream from the soot filters, for controlling the regeneration process, wherein the burner is operated with exhaust gas and is placed downstream from the control flap(s).

The soot filtering arrangement according to the present invention offers the advantage that the burners are operated with exhaust gas, instead of external air, as the oxygen supplier for the burners, so that there is no great need to ensure flap tightness, and the requirement for an air delivery means, such as a blower or compressor, is avoided. Even if the control flaps in such a soot filtering unit are leaky, or become leaky over time, this poses no difficulties during operation of the burner since the burner then receives just possibly only a slightly greater amount of exhaust gas for its operation. Since the burner (seen in the direction of the exhaust gas stream) is placed behind the control flap for the regeneration process, and this flap is closed for carrying out the regeneration process, during regeneration the burner can be operated according to requirements in a controllable way without exhaust gas from the internal combustion engine constantly flowing through it. The amount of exhaust gas necessary for the operation of the burner can be fed to the burner in many ways, which will be explained in more detail below. Since the burner is intended for the regeneration of a so-called double soot filtering unit, in which two parallel soot filters are used, a desired amount of gas can be fed to the burner. This means that the burner output can be set in any way and thus an optimal regeneration behavior can be established.

Preferably, an exhaust gas feed pipe is connected to the burner that branches off from the exhaust gas line of the diesel internal combustion engine, at or upstream from the branching point to the parallel soot filters. Through this exhaust gas feed pipe, exhaust gas can be fed, optionally adjustably, to the combustion air intake of the burner for operation during the regeneration process, even if the control flap assigned to the soot filter to be regenerated is closed and the other soot filter is used for soot filtering.

According to an advantageous configuration according to the invention, a single burner preferably serves the two soot filters so that the structural volume of such a soot filtering unit can be reduced overall and thus, naturally, the costs for such a unit also can be reduced.

To guarantee that operation of the burner is largely independent of and uninfluenced by the design of the exhaust gas unit of the internal combustion engine, a flow control device may be placed in the exhaust gas feed pipe to the burner. This flow control device is, preferably, formed by a flap that regulates the amount of exhaust gas supplied.

If, as indicated above, one burner is used for the regeneration of both soot filters in an alternating sequence, then, advantageously, at least one flap is placed downstream from the burner to guide the high temperature gases produced by the burner to the one of the soot filters to be regenerated, where the temperature of these gases is used to remove the soot collected. In this case, the design can be made in such a way that, in the area of the burner outlet, a branch pipe section is provided and the high temperature gases produced by the burner are conveyed by appropriate positioning of the flap in the branch pipe section to direct these gases to the respective soot filter to be regenerated.

According to an especially advantageous configuration according to the invention, a single flap is provided that controls the path of the engine exhaust gas and that of the regeneration gas. With such a design, at the area where the exhaust pipe branches to the parallel soot filters, only a single flap is then necessary. There are no great demands ,for tightness to be placed even on such a flap, since, in case the flap becomes leaky, it only results in the high temperature regeneration gases supplied by the burner being mixed with a small portion of exhaust gas, specifically that from the leakage at the flap. Such a result hardly impairs the operation of the burner since a higher gas pressure is always present in the burner.

According to an alternative configuration, the burner outlet is connected to separate gas feed pipes for each filter. In each of these feed pipes at least one flap is placed, so that by controlling the position of these flaps the soot filter that is desired to be regenerated can be supplied with the high temperature gases from the burner outlet for starting the regeneration process.

A further embodiment according to the invention provides a design wherein a burner is placed upstream from each filter so that, seen overall, with a double filter unit, two burners are used which are operated independently of each other for soot filter regeneration. This results in the advantage that the respective burner can be placed directly in the exhaust gas pipe section leading to the filter, and supplying the burner with exhaust gas for combustion purposes occurs by a calculated adjustable leakage area of the upstream control flap. Thus, in this case, there is consciously a leakage opening present at the control flaps and the amount of combustible gas from the burner equals the amount of gas leaked from the respective control flap. With such a configuration, no additional exhaust gas feed pipes to the burners are needed and, in particular, the control flaps can consciously be made leaky.

According to a suitable further embodiment according to the invention, the exhaust gas line branches upstream from each burner and a single flap is placed in the branching point as a control common to both burners. Also, with this design the leakage current at this common flap corresponds to the gas stream required to operate the burner with exhaust gas. This results in the advantage over the previously described configurations that, for structural simplification, only a single flap is needed that acts both as a control flap for the soot filter regeneration and for supplying an amount of exhaust gas to operate the burner.

According to another alternative configuration according to the invention, a control flap is placed in each exhaust gas pipe section leading to a filter, and preferably the burners in each case do not lie directly in the exhaust gas stream, but rather the burner outlet of each burner discharges into a respective exhaust gas pipe section and the burners are supplied with exhaust gas by separate feed pipes so that the burner, during normal filter operation, has practically no exhaust gas flowing through it or around it. Consequently, interruptions in the burner operation, for example, caused by fouling, can more easily be avoided and the burner does not lead to increased flow resistance for the engine exhaust gas. By insertion of a control flap, of course, flow-through of engine exhaust gas, when the burner is in, can be almost completely avoided.

A suitable configuration according to the invention is wherein the regeneration device is placed between an exhaust gas receptacle, which preferably acts as a front muffler, and the parallel soot filters. In the configurations wherein exhaust gas is separately supplied to the burner or burners through an exhaust gas feed pipe, these exhaust gas feed pipes are connected to the receptacle. If, on the other hand, the burner is in the exhaust gas stream to the respective soot filter, the amount of exhaust gas fed to each burner may be controlled with the aid of the upstream control flaps, which are adjustable with regard to the degree that they are open for that purpose.

These and further objects, features and advantages of the present invention will become more obvious from the following description when taken in connection with the accompanying drawings which show, for purposes of illustration only, several embodiments in accordance with the present invention.

DETAILED DESCRIPTION OF THE PREFERRED EMBODIMENTS

Figure 1:
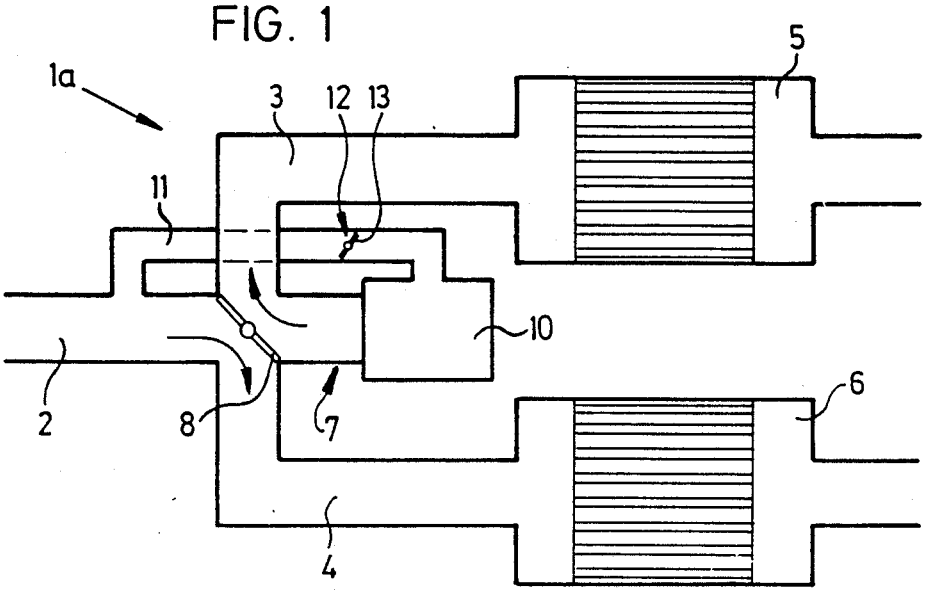
FIG. 1 is a diagrammatic view of a first configuration of a soot filtering unit according to a preferred embodiment of the invention.

In the figures of the drawing the elements that are common to different embodiments are provided with the same reference numerals. However, the various configurations of the preferred embodiments that are explained with reference to FIGS. 1–5, although all being designated generally by reference numeral 1, are distinguished alphabetically as 1*a* (FIG. 1), 1*b* (FIG. 2), 1*c* (FIG. 3), 1*d* (FIG. 4), and 1*e* (FIG. 5), respectively.

In the soot filtering unit identified overall by 1*a*, 2 designates an exhaust gas line leading away from an engine block (not represented) of a diesel internal combustion engine. This exhaust gas line 2 branches into two parallel pipe sections 3 and 4, in each of which a soot filter 5,. 6 is disposed. As the regeneration device, which is designated overall by numeral 7, a control flap 8 and a diagrammatically shown burner 10 are provided. Burner 10, on its intake side, is connected to an exhaust gas feed pipe 11, which branches off from exhaust gas pipe 2 upstream from control flap 8. Although not absolutely necessary, in the example shown, a flap 13 is placed in this exhaust gas feed pipe 11 as flow volume control device 12. In this embodiment, for the regeneration of both soot filters 5, 6 there are thus needed only one common burner 10 and a single control flap 8 which, in this case, has a dual function since it not only uncouples soot filter 5 from exhaust gas pipe 2 (in the position shown in FIG. 1) to regenerate soot filter 5, but it also simultaneously guides the high temperature regeneration gas stream supplied by burner 10 to pipe section 3, by which the high temperature gases are conveyed to soot filter 5.

In this embodiment, burner 10 is fed with exhaust gas from the exhaust gas outlet of the diesel internal combustion engine and the exhaust gas acts as the oxygen carrier for the combustion process in burner 10. Since burner 10 receives any selectable amount of exhaust gas, a burner with smaller output can also be selected to generate the high temperature gases used for bringing the soot collected in the soot filter to its ignition temperature. Further, since burner 10 operates with exhaust gas as the oxygen carrier (instead of an external supply of combustion air), no great demands need be placed on the tightness of control flaps 8 since the leakage currents do not noticeably impair the operation of burner 10, but rather only mix with the hot gases, supplied by burner 10 during operation, in the area of control flap 8. The gas stream conveyed to burner 10 can, optionally, be controlled with the aid of flap 13. Since burner 10 does not lie directly in the exhaust gas stream when, for example, soot filter 5 is in operation, on the one hand, burner 10 is protected to a large extent from being fouled by the exhaust gas during filter operation and, on the other hand, it also creates no additional resistance in exhaust gas pipe 2 and 3, through which flows the exhaust gas during filter operation with the aid of soot filter 5. In an analogous way, the preceding explanations also apply to the regeneration of soot filter 6, for which, then, control flap 8 is turned about 90° from the position illustrated.

Figure 2:
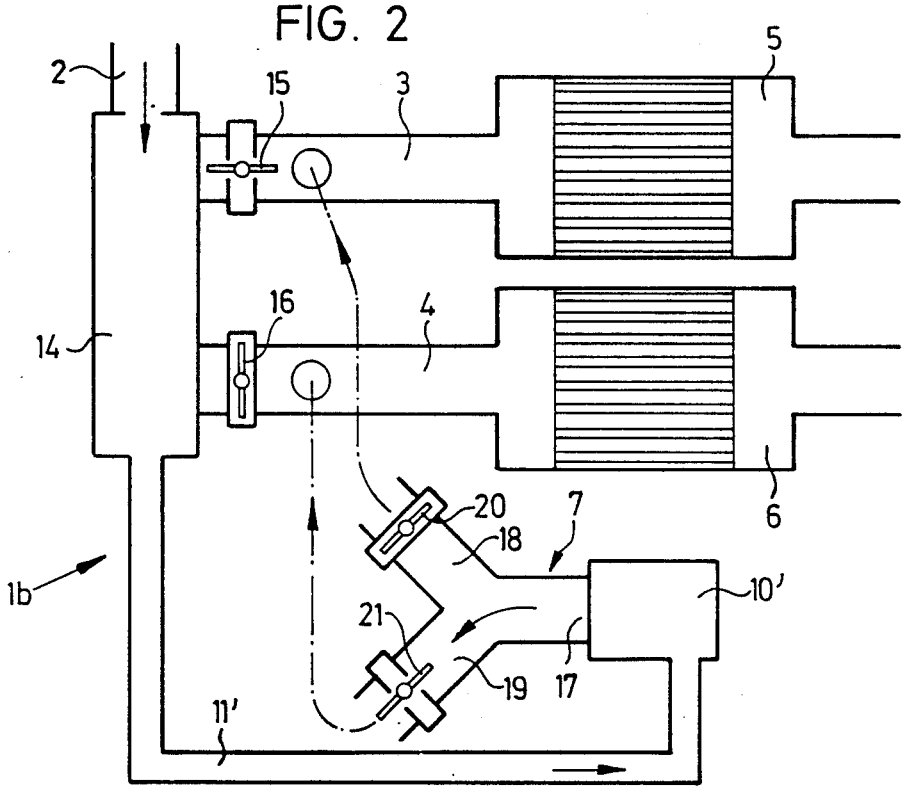
FIG. 2 is another embodiment of the invention which, like that of the FIG. 1 embodiment, uses a single burner for the regeneration of both soot filters.

In FIG. 2, the soot filtering unit is designated overall by numeral 1*b*. Here, there is, additionally, placed an exhaust gas receptacle that is constructed, for example, as front muffler 14 and into which the exhaust gas pipe 2 discharges. The parallel pipe sections 3 and 4, in which soot filters 5, 6 lie, go off from this front muffler 14. In pipe sections 3 and 4 there is, in each case, a control flap 15, 16.

As in the embodiment of FIG. 1, in soot filtering unit 1*b* according to FIG. 2, a single burner is provided that is designated by 10' in FIG. 2. Burner 10' is supplied with exhaust gas by an exhaust gas feed pipe 11', which leads to it from the front muffler 14, in the example shown. The outlet 17 of burner 10' branches into two pipe sections 18, 19 and a flap 20, 21 is placed in each of these pipe sections 18. 19. The pipe section designated by 18, in which flap 20 is placed, discharges into pipe section 3 downstream from the control flap 15 provided there. Pipe section 19, in which flap 21 is provided, discharges into pipe section 4 downstream from the control flap 16 provided there. With this configuration, a low output burner 10' is also sufficient and no great demands for tightness are placed on any of the flaps present in the pipe system, such as control flaps 15, 16 and flaps 20, 21, since any leakage occurring, basically, will not produce any significant impairment of performance during filter regeneration and/or operation of burner 10'.

In the circumstances illustrated in FIG. 2, soot filter 6 is being regenerated and soot filtering of the exhaust discharge is being carried out by filter 5, and, accordingly, control flap 15 is open and control flap 16 is closed. Furthermore, flap 20 in pipe section 18 is closed and flap 21 in pipe section 19 is open, so that, when burner 10'is in operation, high temperature regeneration gases are introduced, from burner 10', through pipe section 19 into pipe section 4 from which they flow to soot filter 6 so that it can be regenerated. If soot filter 5 is to be regenerated, control flaps 15 and 16 and flaps 20 and 21 assume positions that are exactly the opposite of the positions described above. In this case, the high temperature gas is fed from burner 10'to soot filter 5 through pipe section 18 and pipe section 3.

Figure 3:
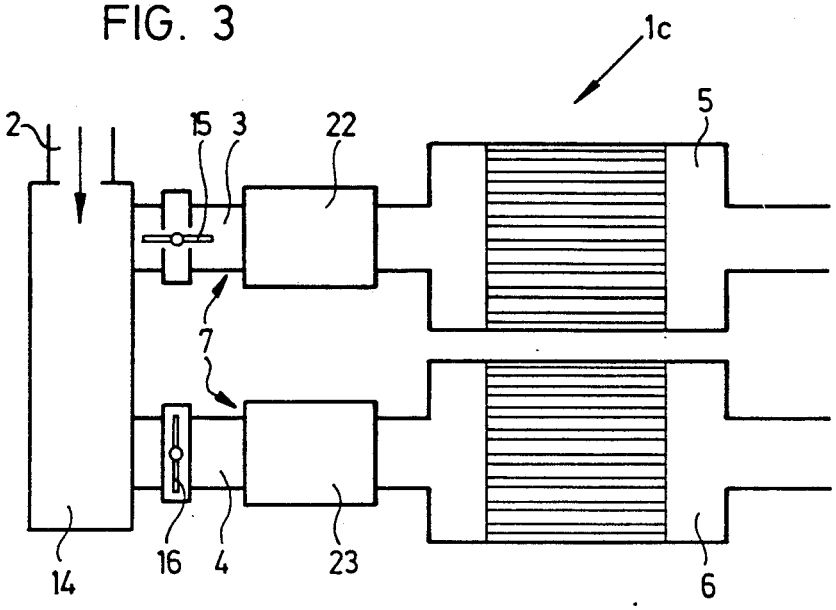
FIG. 3 is a modified embodiment of a soot filtering unit wherein a burner is provided for each soot filter.

In the soot filtering unit 1*c* shown in FIG. 3, as in FIG. 2, a front muffler 14 is provided into which exhaust gas line 2 discharges. Pipe sections 3, 4, containing soot filters 5, 6 branch off from this front muffler 14. Control flaps 15, 16 are placed in each of pipe sections 3, 4, and downstream from these control flaps 15, 16 a burner 22. 23, operated by exhaust gas, is placed directly in pipe section 3 or 4, respectively. In the configuration shown in FIG. 3, the control flaps 15, 16 are purposely designed to allow a predetermined amount of leakage when closed so that a corresponding amount of exhaust gas is fed to burner 22 or 23 for operation during regeneration of the respective soot filter 5, 6. Thus, in this configuration, large flap openings in control flaps 15, 16 can be accepted and at least a predetermined flap opening size must be maintained to supply burner 22 or 23 with exhaust gas for regeneration.

As shown in FIG. 3, soot filter 6 is being regenerated so that control flap 16 is, thus, in its closed position, but a sufficient quantity of exhaust gases from front muffler 14 still pass through the flap opening to burner 23. The amount of exhaust gas fed to the burner is controllable in each case, for which the flap is adjustable to vary the opening gap. When burner 23 is operating, it produces high temperature gases that are fed by a very short portion of pipe section 4 directly to soot filter 6. Regeneration of soot filter 5 is performed in an analogous way, by having control flap 16 assume its open position, in which it is turned about 90° relative to the position shown in FIG. 3. Control flap 15, then, assumes its closed position, similar to the position in which control flap 16 is shown in FIG. 3.

Figure 4:
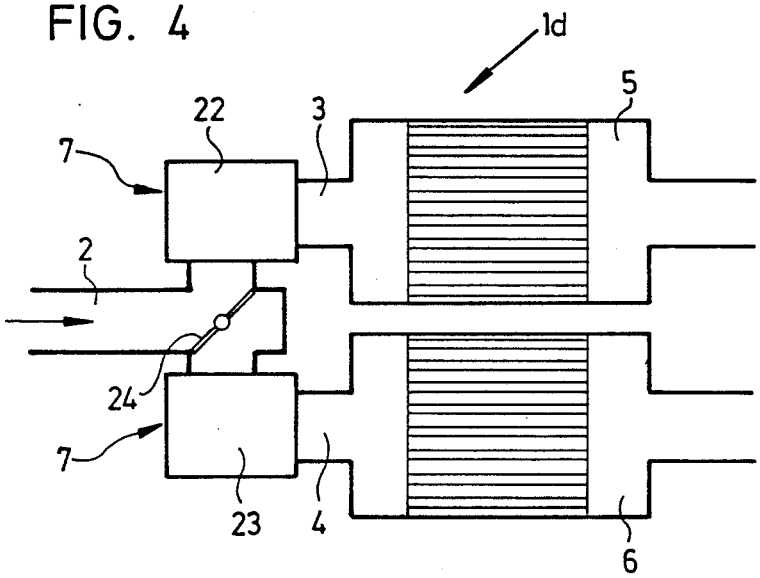
FIG. 4 shows a modification to the embodiment of FIG. 3 to enable a single flap to control gas flow to both of the burners.

The configuration of soot filtering unit 1*d* in FIG. 4 is similar to that of FIG. 3 in that two burners 22, 23, supplied with exhaust gas from exhaust gas line 2, are used for carrying out regeneration of soot filters 5, 6, respectively. However, in contrast to the unit of FIG. 3, that of FIG. 4 uses only a single control flap 24, which is placed in the area of exhaust gas line 2 at which exhaust it branches into pipe sections 3, 4. Nonetheless, exhaust gas is still intended to be supplied to burner 22 or 23 for operation thereof by a predetermined amount of leakage passing by the flap 24; although the amount of exhaust gas to the burners is controllable by adjustment of control flap 24, as well. In the position shown in FIG. 4, soot filter 5 is in filter operation and soot filter 6 is being regenerated with the aid of burner 23. Regeneration of soot filter 5, then, occurs when control flap 24 assumes a position that is turned about 90° relative to the position shown in FIG. 4.

Figure 5:
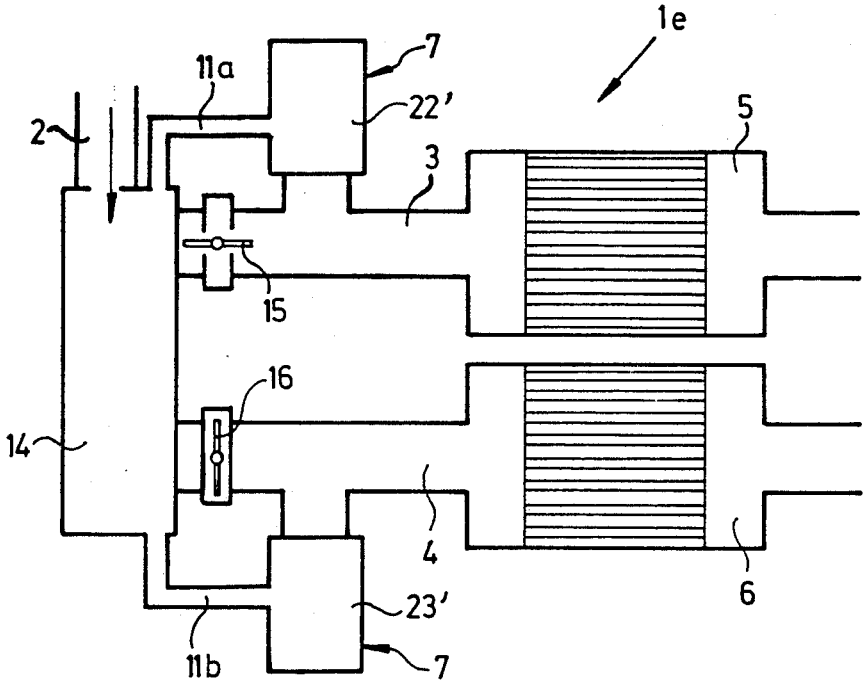
FIG. 5 is a further embodiment having a burner for each soot filter, but in which the burners are not directly in the exhaust gas pipes to the soot filters.

FIG. 5 shows a soot filtering unit, designated overall by 1*e*, which is similar to that of FIG. 3 in that exhaust gas line 2 discharges into front muffler 14 and pipe sections 3, 4, in which soot filters 5, 6 lie, branch off from the front muffler 14, and with control flaps 15, 16 being placed in these pipe sections 3. 4. Where this embodiment differs from the configuration 1*c* according to FIG. 3 is in the fact that the soot filtering unit le, according to FIG. 5, has two burners 22'and 23'which do not lie directly in the exhaust gas stream, but whose outlet discharges into the respective pipe section 3,4. Burners 22', 23' are supplied with exhaust gas by gas feed pipes 11*a*, 11*b*, respectively, the feed pipes 11*a*, 11*b* being connected to front muffler 14. Although not shown. flow volume control devices similar to those shown, for example, in FIG. 1 and designated there by 12 and 13 can, optionally, be provided in exhaust gas feed pipes 11*a*, 11*b*. Also, in the soot filtering unit 1*e* of FIG. 5, two burners 22', 23' are thus provided which, during filter operation, are protected from exhaust gases to a large extent and do not create additional flow resistance in the pipe sections 3. 4, within which soot filters 5, 6 are placed.

While the specific construction of the burners of the above-described embodiments does not, itself, form part of the present invention, as will be recognized by those skilled in the art, care should be taken to ensure that whatever burner is used, the exhaust gases do not subject it to thermal overloading or clogging, a problem which varies primarily when the exhaust gases are permitted to impinge on the burner nozzle and burner ignition parts when the burner is inoperative during normal filter operation. Thus, the burners, e.g., burners 22, 23, will be designed to avoid the problem of clogging and/or thermal overloading by using screening or shielding elements or the like to prevent direct impingement of the exhaust gases upon the nozzle and ignition parts of the burner, and/or by placing the burner nozzle in parallel to the flow of exhaust gases so that the exhaust gases will bypass the nozzle and ignition parts. A great variety of other measures to protect the burners of differing types exist, and as noted such details, themselves, form no part of this invention.

While I have shown and described various embodiments in accordance with the present invention, it is understood that the same is not limited thereto, but is susceptible of numerous changes and modifications as known to those skilled in the art, such as the use of more than two soot filters in parallel, and I, therefore, do not wish to be limited to the details shown and described herein, but intend to cover all such changes and modifications as are encompassed by the scope of the appended claims.

I claim:

1. Soot filtering unit for a diesel internal combustion engine comprising at least two soot filters arranged in parallel branches of an exhaust gas line and a regeneration device with at least one burner for producing high temperature gases for regeneration of the soot filters, and with at least one control flap in the exhaust gas line for controlling flow through the exhaust gas line; wherein said at least one burner is exhaust gas operated and, for that purpose, has a fuel intake and an oxygen intake connected to said exhaust gas line by an exhaust feed pipe as a means for receiving oxygen for combustion purposes, and wherein an outlet of said at least one burner is connected to said exhaust gas line downstream of said at least one control flap as a means for delivering said high temperature gases thereto, and wherein another control flap is placed in said exhaust gas feed pipe as a flow control device for regulating the amount of exhaust gas fed to the oxygen intake of the burner.

2. Soot filtering unit according to claim 1, wherein at least one exhaust gas feed pipe branches off from the exhaust gas line upstream of said at least one control flap as a means for delivering exhaust gases to the oxygen intake of said at least one burner.

3. Soot filtering unit according to claim 2, wherein a single burner is provided for regeneration of both of said soot filters.

4. Soot filtering unit according to claim 3, wherein said at least one control flap is provided downstream of said burner as a means for guiding the high temperature gases produced by the burner to one of said soot filters.

5. Soot filtering unit according to claim 1, wherein a single control flap is placed at a branching area between said parallel branches of the exhaust gas line.

6. Soot filtering device according to claim 1, wherein a said burner is placed upstream from each of said soot filters.

7. Soot filtering device according to claim 6, wherein each burner is placed directly in a respective one of said parallel branches.

8. Soot filtering unit according to claim 7, wherein said exhaust gas line is branched at a point upstream from each burner and a single said control flap is placed in the branching point as a means for controlling flow through both of said parallel branches of the exhaust gas line.

9. Soot filtering unit according to claim 6, wherein a said control flap is placed upstream from each burner in each of said parallel branches of the exhaust gas line.

10. Soot filtering unit according to claim 9, wherein the outlet of each burner discharges into a section of a respective branch of the exhaust gas line that leads to a respective one of the soot filters; and wherein the intake of each burner is connected to an exhaust gas feed pipe that branches off from the exhaust line upstream from a respective control flap as a means for delivering exhaust gases to the oxygen intake of the burner.

11. Soot filtering unit according to claim 10, wherein the regeneration device is placed between an exhaust gas receptacle and the soot filters.

12. Soot filtering unit according to claim 11, wherein said exhaust gas receptacle is a muffler.

13. Soot filtering unit according to claim 7, wherein the regeneration device is placed between an exhaust gas muffler and the soot filters.

14. Soot filtering unit according to claim 7, wherein a said control flap is placed upstream from each burner in each of said parallel branches of the exhaust gas line.

15. In a soot filtering unit for a diesel internal combustion engine of the type having a plurality of soot filters arranged in parallel flow paths of an exhaust line from the engine and having at least one burner, having a fuel intake and an oxygen intake for producing high temperature regeneration gases, said burner being connected in a manner for selectively delivering said high temperature regeneration gases to said soot filters for regeneration thereof, and having at least one control flap for controlling said selective delivery of high temperature regeneration gases, the improvement, as a means for enabling said at least one burner to be a low output burner and for eliminating the need for said at least one control flap to have a substantially leak-free closed position, comprising said at least one burner having said oxygen intake connected to said exhaust line as a means for operating said burner using exhaust gas from said exhaust line as a combustion air an oxygen source for production of said high temperature regeneration gases by combustion of fuel from said fuel intake, and a flow control device in the form of another control flap for regulating the amount of exhaust gas fed to the oxygen intake of the burner.

* * * * *